US009728124B2

(12) United States Patent
Qi et al.

(10) Patent No.: US 9,728,124 B2
(45) Date of Patent: Aug. 8, 2017

(54) ADAPTIVE RGB-TO-RGBW CONVERSION FOR RGBW DISPLAY SYSTEMS

(71) Applicant: Apple Inc., Cupertino, CA (US)

(72) Inventors: Jun Qi, Cupertino, CA (US); Gabriel Marcu, San Jose, CA (US); Victor H. Yin, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 3 days.

(21) Appl. No.: 14/270,693

(22) Filed: May 6, 2014

(65) Prior Publication Data

US 2014/0333683 A1 Nov. 13, 2014

Related U.S. Application Data

(60) Provisional application No. 61/821,165, filed on May 8, 2013.

(51) Int. Cl.
*G09G 3/32* (2016.01)
*G09G 3/3233* (2016.01)

(52) U.S. Cl.
CPC ... *G09G 3/3233* (2013.01); *G09G 2300/0452* (2013.01); *G09G 2340/06* (2013.01); *G09G 2360/144* (2013.01)

(58) Field of Classification Search
CPC ..... G09G 2320/0233; G09G 2340/06; G09G 3/3208; G09G 2320/0666;
(Continued)

(56) References Cited

U.S. PATENT DOCUMENTS

2004/0217694 A1* 11/2004 Cok et al. ..... 313/504
2007/0146252 A1* 6/2007 Miller ..... G09G 3/3233 345/77

(Continued)

OTHER PUBLICATIONS

Brown Elliott et al., "Adding a White Subpixel," Color Rendering, SID '06, Symposium, Seminar and Exhibition, San Francisco, California, Jun. 4-9, 2006 (6 pages) [Retrieved on May 6, 2014]. Retrieved from the Internet:<URL: http://www2.units.it/ipl/students_area/imm2/files/DLP_RGBW/Adding-a-White.pdf>.

(Continued)

*Primary Examiner* — Nalini Mummalaneni
*Assistant Examiner* — James Nokham
(74) *Attorney, Agent, or Firm* — Treyz Law Group, P.C.; Kendall W. Abbasi; Zachary D. Hadd

(57) ABSTRACT

An electronic device may include a display having an array of display pixels. Each display pixel may include a red subpixel, a green subpixel, a blue subpixel, and a white subpixel. The display may be controlled using display control circuitry. The display control circuitry may convert frames of display data from a red-green-blue (RGB) color space to a red-green-blue-white (RGBW) color space. The display control circuitry may supply data signals corresponding to a frame of display data in the RGBW color space to the array of display pixels. A frame of display data may be converted from the RGB color space to the RGBW color space based on an amount of color saturation in the frame of display data, based on information identifying what code is running on control circuitry in the electronic device, and/or based on ambient lighting condition information.

17 Claims, 11 Drawing Sheets

(58) Field of Classification Search
CPC ... G09G 2300/0452; G09G 2320/0673; G09G 3/36; G09G 3/3233; G09G 2360/144
USPC ... 345/102, 690, 590, 211, 600, 77–80, 601, 345/86–88
See application file for complete search history.

(56) References Cited

U.S. PATENT DOCUMENTS

2007/0171218 A1* 7/2007 Hong ..... G09G 3/3406 345/211
2007/0279372 A1* 12/2007 Brown Elliott et al. ..... 345/102
2008/0204380 A1* 8/2008 Shin ..... G09G 3/2003 345/80
2008/0204480 A1* 8/2008 Van Mourik et al. ..... 345/690
2010/0103187 A1* 4/2010 Linssen ..... 345/590
2011/0109658 A1* 5/2011 Park ..... G09G 3/3406 345/690
2011/0148910 A1* 6/2011 Botzas ..... G09G 5/02 345/600
2013/0093783 A1* 4/2013 Sullivan ..... G09G 5/06 345/601
2013/0106901 A1* 5/2013 Inada ..... G09G 3/3406 345/600
2014/0267442 A1* 9/2014 Lin ..... G09G 3/3208 345/690

OTHER PUBLICATIONS

Spindler et al., "System considerations for RGBW OLED displays," Journal of the SID Jan. 14, 2006 (12 pages) [Retrieved on May 6, 2014]. Retrieved from the Internet:<URL:http://reshal.ru/wp-content/uploads/2011/11/8-System-OLED.pdf>.

* cited by examiner

ADAPTIVE RGB-TO-RGBW CONVERSION FOR RGBW DISPLAY SYSTEMS

This application claims the benefit of provisional patent application No. 61/821,165, filed May 8, 2013, which is hereby incorporated by reference herein in its entirety.

BACKGROUND

This relates generally to electronic devices with displays and, more particularly, to electronic devices with displays having adaptive color gamuts.

Electronic devices such as computers, media players, cellular telephones, set-top boxes, and other electronic equipment are often provided with displays for displaying visual information.

Displays such as organic light-emitting diode (OLED) displays typically include an array of display pixels. Each display pixel may include one or more colored subpixels (e.g., a red subpixel, a green subpixel, and a blue subpixel) for displaying color images.

In some types of OLED displays, each colored subpixel is formed from colored OLED material (i.e., OLED material that emits light of a given color). With this type of configuration, each display pixel typically includes a red OLED subpixel formed from red OLED material (sometimes referred to as a red "emitter"), a green OLED subpixel formed from green OLED material (sometimes referred to as a green "emitter"), and a blue OLED subpixel formed from blue OLED material (sometimes referred to as a blue "emitter"). Each color of light-emitting material is deposited on a display substrate in a separate color patterning step.

In other types of OLED displays, colored subpixels are formed by covering white OLED material (sometimes referred to as a white "emitter") with color filter material. For example, an OLED display can be formed by covering an array of white OLED emitters with an array of red, green, and blue color filter elements (sometimes referred to as an RGB color filter array). The fabrication process used to manufacture an OLED display based on white emitters with an RGB color filter array can be less costly and less complex than that used to manufacture an OLED display based on patterned RGB emitters. However, because light is required to pass through a color filter, OLED displays based on white emitters with color filters are typically less power efficient than those based on patterned RGB emitters.

To increase the power efficiency of OLED displays based on white emitters, some displays employ an RGBW pixel array in which each subpixel includes a red subpixel formed from a white emitter covered with a red color filter, a green subpixel formed from a white emitter covered with a green color filter, a blue subpixel formed from a white emitter covered with a blue color filter, and a white subpixel formed from a white emitter without a color filter. Because the white subpixel does not include a color filter, it typically consumes significantly less power than red, green, and blue subpixels. Rendering colors using the white subpixel in combination with red, green, and blue subpixels may therefore increase the power efficiency of a display.

It can be challenging, however, to achieve sufficient power efficiency using the white subpixel without negatively affecting the color gamut of the display. For example, increasing the luminance contribution from the white subpixel to display a given color will result in lower power consumption but may also make it difficult to accurately display highly saturated colors. On the other hand, a luminance contribution from the white subpixel that is too low can require an excessive amount of power.

It would therefore be desirable to be able to provide improved ways of displaying images on displays such as OLED displays.

SUMMARY

An electronic device may include a display having an array of display pixels. Each display pixel may include a red subpixel, a green subpixel, a blue subpixel, and a white subpixel. The display may be controlled using display control circuitry.

The display control circuitry may convert frames of display data from a red-green-blue (RGB) color space to a red-green-blue-white (RGBW) color space. The display control circuitry may supply data signals corresponding to a frame of display data in the RGBW color space to the array of display pixels. The display control circuitry may, for example, include a timing controller integrated circuit that converts frames of display data from the RGB color space to the RGBW color space and provides the corresponding data signals to the display.

A frame of display data may be converted from the RGB color space to the RGBW color space based on an amount of color saturation in the frame of display data. For example, the display control circuitry may determine a color saturation parameter value representative of an amount of color saturation associated with a frame of the display data. The color saturation parameter may correspond to the portion of subpixel color values associated with a frame of display data that have a value greater than a predetermined subpixel color value. The display control circuitry may convert RGB values associated with a frame of display data into corresponding RGBW values based on the color saturation parameter value associated with the frame of display data.

A frame of display data may be converted from the RGB color space to the RGBW color space based on information identifying what code is running on control circuitry in the electronic device. For example, the display may be mounted in an electronic device having electronic device control circuitry that runs code. The code may be associated with application software. The display control circuitry in the display may obtain information identifying which application software is running on the electronic device control circuitry. The information identifying which code is running on the electronic device control circuitry may be pushed from the electronic device control circuitry to the display control circuitry or may be pulled from the electronic device control circuitry by the display control circuitry.

A frame of display data may be converted from the RGB color space to the RGBW color based on ambient lighting condition information. For example, an electronic device may include a light sensor configured to gather information on ambient lighting conditions. Display control circuitry in the display may obtain the ambient lighting condition information from the light sensor and may convert frames of display data from the RGB color space to the RGBW color space based on the ambient lighting condition information.

Further features of the invention, its nature and various advantages will be more apparent from the accompanying drawings and the following detailed description of the preferred embodiments.

DETAILED DESCRIPTION

Figure 1:
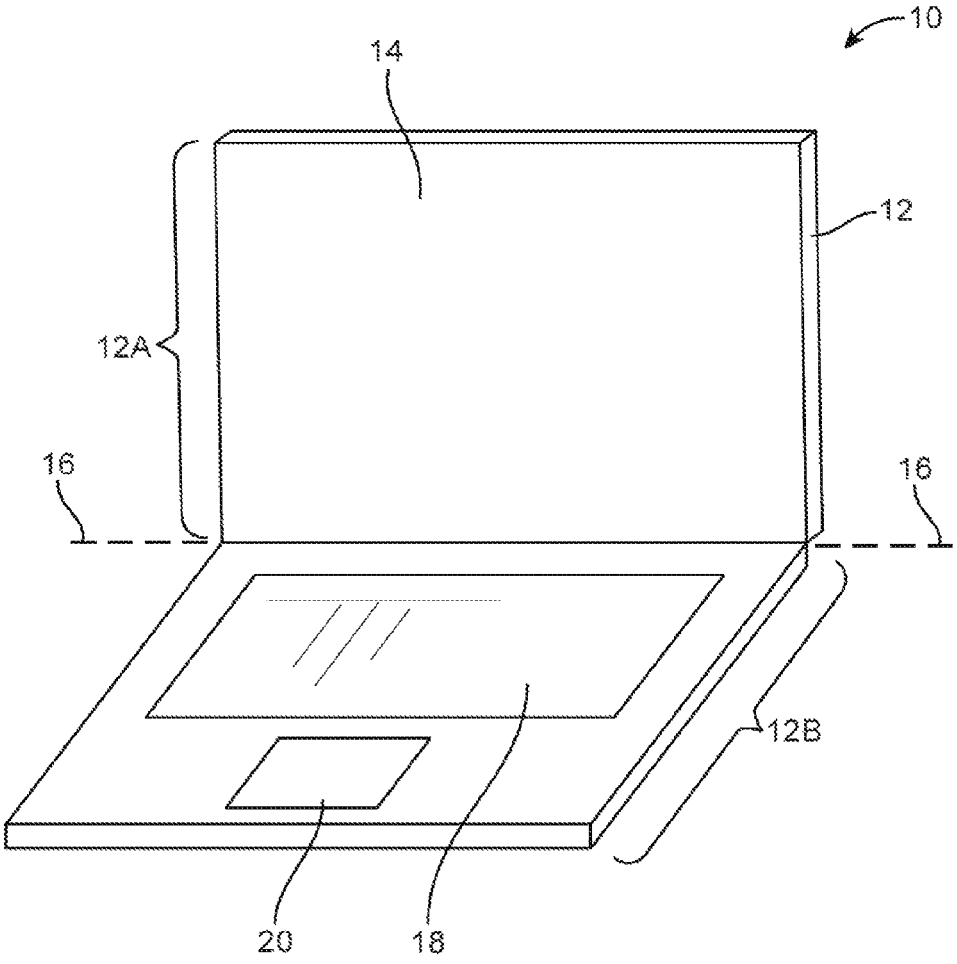
FIG. 1 is a perspective view of an illustrative electronic device such as a portable computer having a display in accordance with an embodiment of the present invention.

Electronic devices such as cellular telephones, media players, computers, set-top boxes, wireless access points, and other electronic equipment may include displays. Displays may be used to present visual information and status data and/or may be used to gather user input data.

Displays such as OLED displays may include an array of OLED display pixels. Each OLED display pixel may include one or more colored subpixels for displaying color images. For example, each OLED pixel may include a red subpixel, a green subpixel, a blue subpixel, and a white subpixel. During display operations, each OLED pixel may receive a red subpixel value, a green subpixel value, a blue subpixel value, and a white subpixel value that together define the color to be created by that pixel. These red, green, blue, and white values are sometimes referred to herein in the aggregate as "RGBW values," as understood to those of ordinary skill in the art.

In some types of OLED displays, colored subpixels such as red, green, and blue subpixels are formed by covering white OLED material (i.e., OLED material that emits white light, sometimes referred to as a white emitter) with a color filter element (e.g., a red, green, or blue color filter element). White subpixels may be formed from white emitters without color filters.

Because white subpixels are unfiltered, white subpixels tend to be more power efficient than red, green, and blue subpixels. It may therefore be beneficial to use the white subpixel to produce a portion of the luminance in a given color. For example, a color may be defined by a given set of RGB values and an RGB luminance. That same color can be produced using an associated set of RGBW values by allocating a portion of the RGB luminance to the white subpixel.

Electronic devices may include display control circuitry for controlling operation of the display. The display control circuitry may be used to convert incoming frames of display data from the RGB color space to the RGBW color space. For example, the display control circuitry may convert incoming red, green, and blue pixel values (sometimes referred to herein in the aggregate as RGB values or subpixel color values) into RGBW values. The algorithm used by the display control circuitry to convert the incoming RGB values into RGBW values determines the portion of the RGB luminance to be contributed by the white subpixel. A greater luminance contribution from the white subpixel to produce a given color will result in greater power savings. However, care must be taken to ensure that the integrity of highly saturated colors is not compromised when saturation integrity is important to a user.

Display control circuitry may adaptively determine the luminance contribution from the white subpixel during operation of the display. For example, the luminance contribution from the white subpixel may be determined based on the color content in a frame of display data (e.g., the amount of color saturation in a frame of display data), based on the power needed to display a frame of display data, based on information identifying what software is running on electronic device control circuitry, based on ambient conditions (e.g., ambient lighting conditions), and/or based on other factors. Controlling the luminance contribution from the white subpixel in this way may result in an adaptive color gamut that maximizes power efficiency without comprising color saturation integrity when color saturation integrity is important to a user.

An illustrative electronic device of the type that may be provided with a display having an adaptive color gamut is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using organic light-emitting diode pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
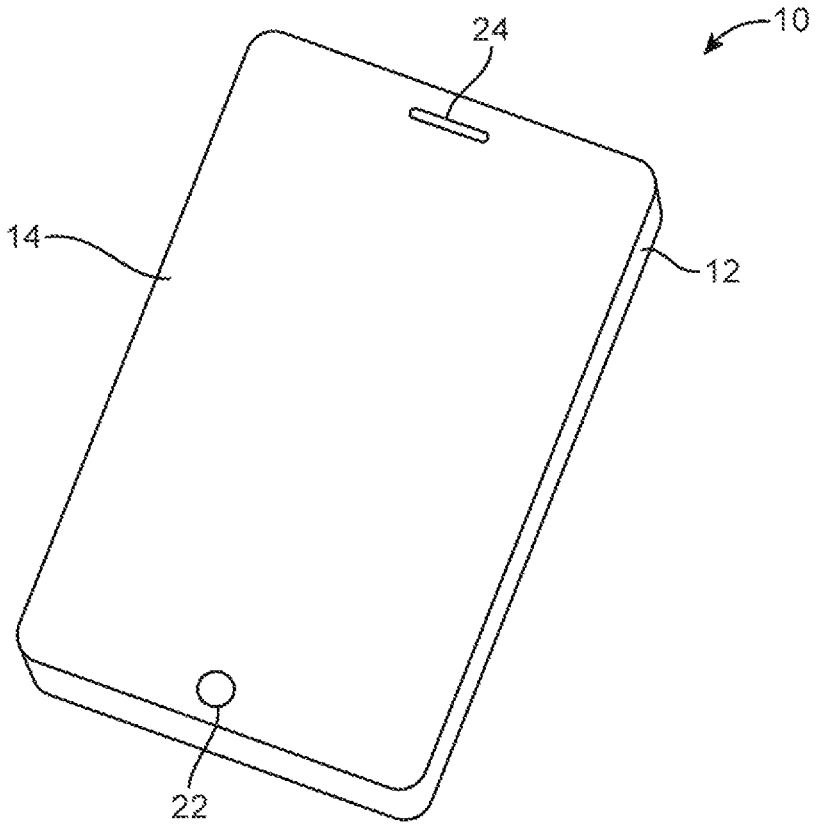
FIG. 2 is a perspective view of an illustrative electronic device such as a cellular telephone or other handheld device having a display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
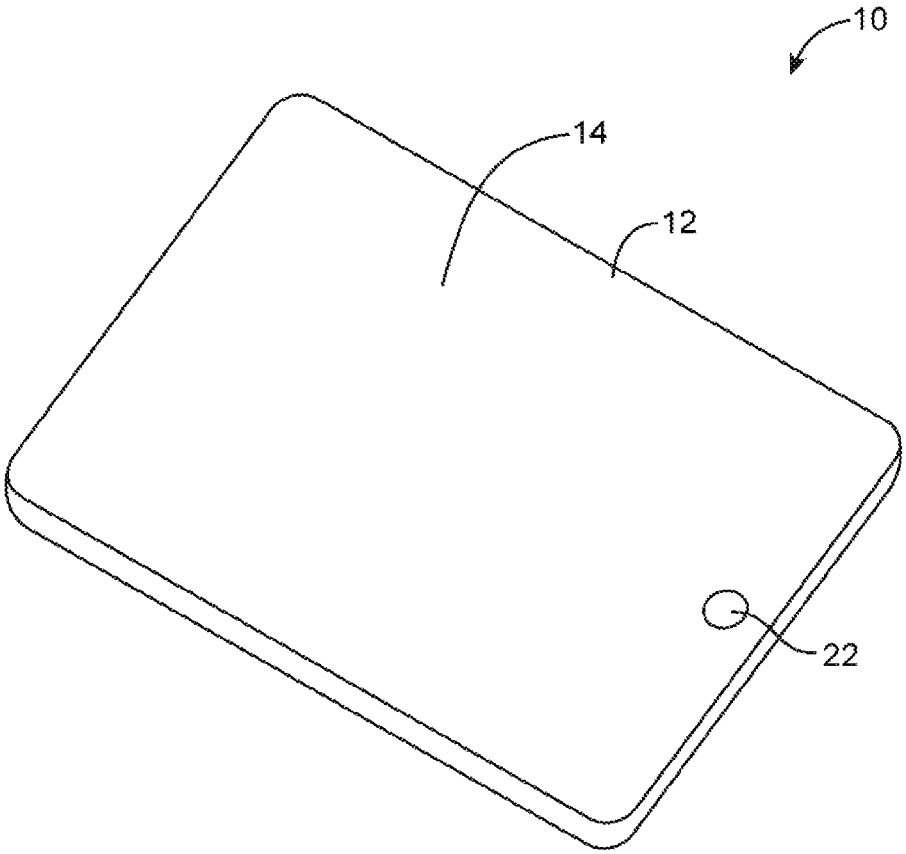
FIG. 3 is a perspective view of an illustrative electronic device such as a tablet computer having a display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
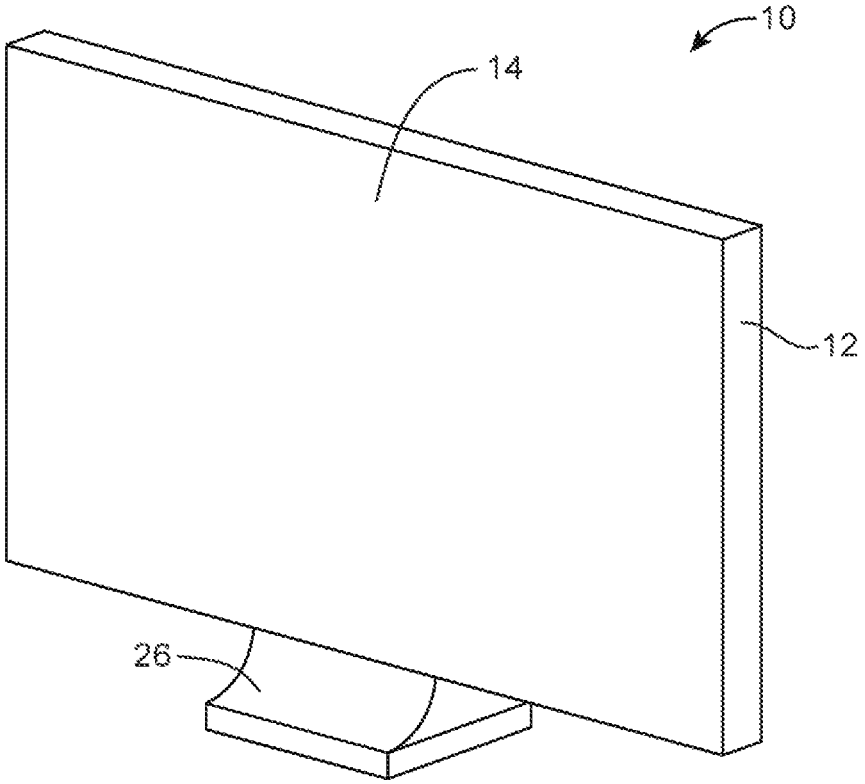
FIG. 4 is a perspective view of an illustrative electronic device such as a computer monitor with a built-in computer having a display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
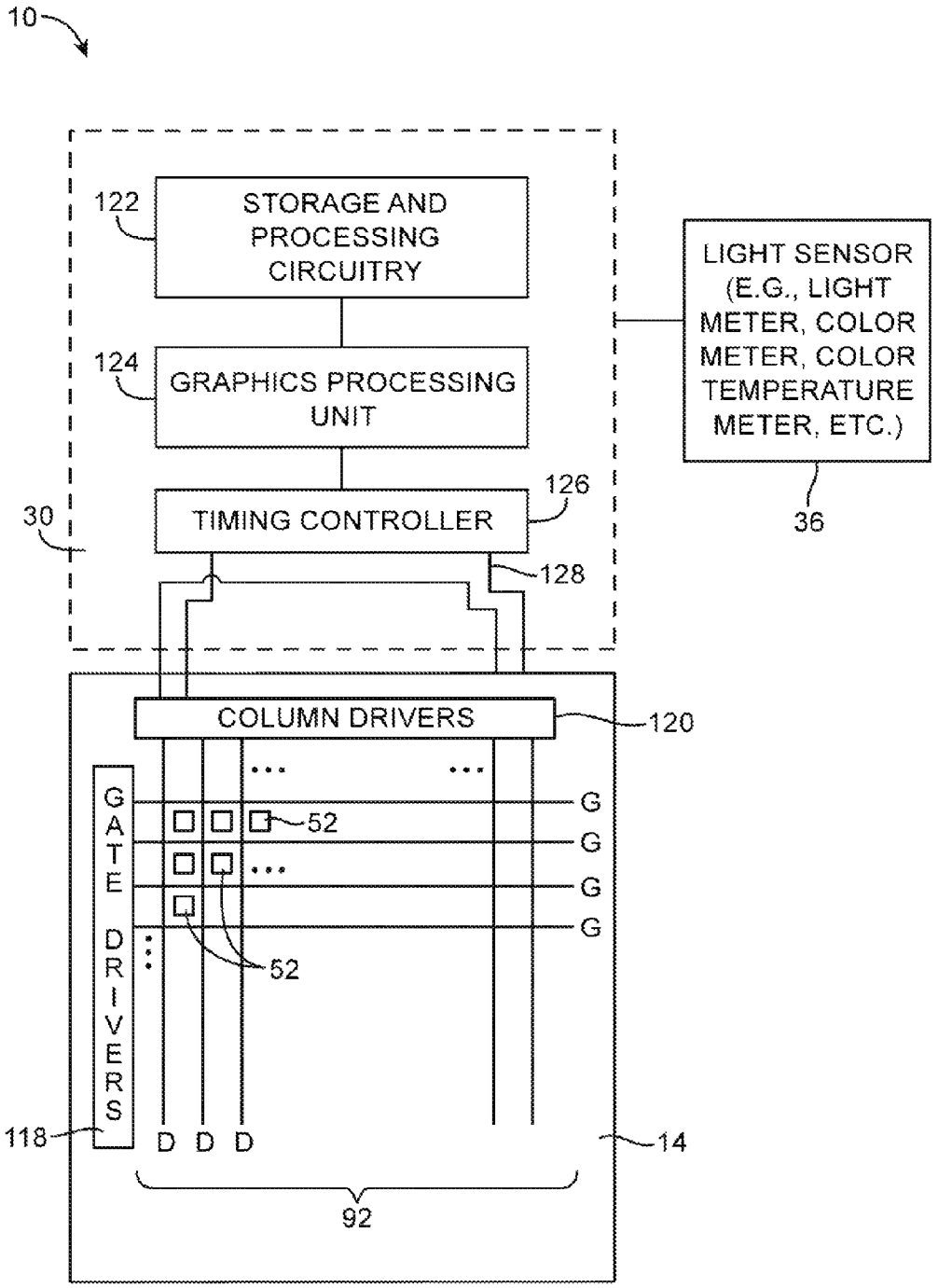
FIG. 5 is a schematic diagram of an illustrative electronic device having a display in accordance with an embodiment of the present invention.

FIG. 5 is a diagram of device 10 showing illustrative circuitry that may be used in displaying images for a user of device 10 on pixel array 92 of display 14. As shown in FIG. 5, display 14 may have column driver circuitry 120 that drives data signals (analog voltages) onto the data lines D of array 92. Gate driver circuitry 118 drives gate line signals onto gate lines G of array 92. Using the data lines and gate lines, display pixels 52 may be configured to display images on display 14 for a user. Gate driver circuitry 118 may be implemented using thin-film transistor circuitry on a display substrate such as a glass or plastic display substrate or may be implemented using integrated circuits that are mounted on the display substrate or attached to the display substrate by a flexible printed circuit or other connecting layer. Column driver circuitry 120 may be implemented using one or more column driver integrated circuits that are mounted on the display substrate or using column driver circuits mounted on other substrates.

Device 10 may include storage and processing circuitry 122. Storage and processing circuitry 122 may include one or more different types of storage such as hard disk drive storage, nonvolatile memory (e.g., flash memory or other electrically-programmable-read-only memory), volatile memory (e.g., static or dynamic random-access-memory), etc. Processing circuitry in storage and processing circuitry 122 may be used in controlling the operation of device 10. The processing circuitry may be based on a processor such as a microprocessor and other suitable integrated circuits. With one suitable arrangement, storage and processing circuitry 122 may be used to run software on device 10, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 10, storage and processing circuitry 122 may produce data that is to be displayed on display 14. This display data may be provided to display control circuitry such as timing controller integrated circuit 126 using graphics processing unit 124.

Timing controller 126 may provide digital display data to column driver circuitry 120 using paths 128. Column driver circuitry 120 may receive the digital display data from timing controller 126. Using digital-to-analog converter circuitry within column driver circuitry 120, column driver circuitry 120 may provide corresponding analog output signals on the data lines D running along the columns of display pixels 52 of array 92.

Storage and processing circuitry 122, graphics processing unit 124, and timing controller 126 may sometimes collectively be referred to herein as display control circuitry 30. Display control circuitry 30 may be used in controlling the operation of display 14. This may incoming frames of display data from an RGB color space to an RGBW color space. This may include, for example, adaptively determining a portion of the RGB luminance to be contributed by the white subpixel. Display control circuitry 30 may supply data signals corresponding to the frames of display data in the RGBW color space to display pixel array 92.

The luminance contribution from the white subpixel may be determined based on the color content in a frame of display data (e.g., the amount of color saturation in a frame of display data), based on the power needed to display a frame of display data, based on information identifying what software is running on electronic device control circuitry, based on ambient conditions (e.g., ambient lighting conditions), and/or based on other factors. This allows display control circuitry 30 to perform on-the-fly, adaptive color gamut mapping from the RGB color space to the RGBW color space.

As shown in FIG. 5, device 10 may include one or more sensors such as light sensor 36. Light sensor 36 may include one or more light meters, one or more color meters, one or more color temperature meters, and/or other types of light sensors. Light sensor 36 may be configured to gather color information, illuminance information, luminance information, and/or color temperature information from the surrounding scene. Light sensor 36 may supply readings such as color chromaticity coordinates (x,y), illuminance readings, luminance readings, and/or correlated color temperature (CCT) readings to display control circuitry 30. Display control circuitry 30 may use the ambient lighting condition information provided by light sensor 36 to determine a portion of RGB luminance to be contributed by the white pixel. For example, a higher luminance contribution from the white subpixel in bright light ambient conditions may increase the display luminance and may help prevent the display from appearing washed out in the bright light ambient conditions.

Figure 6:
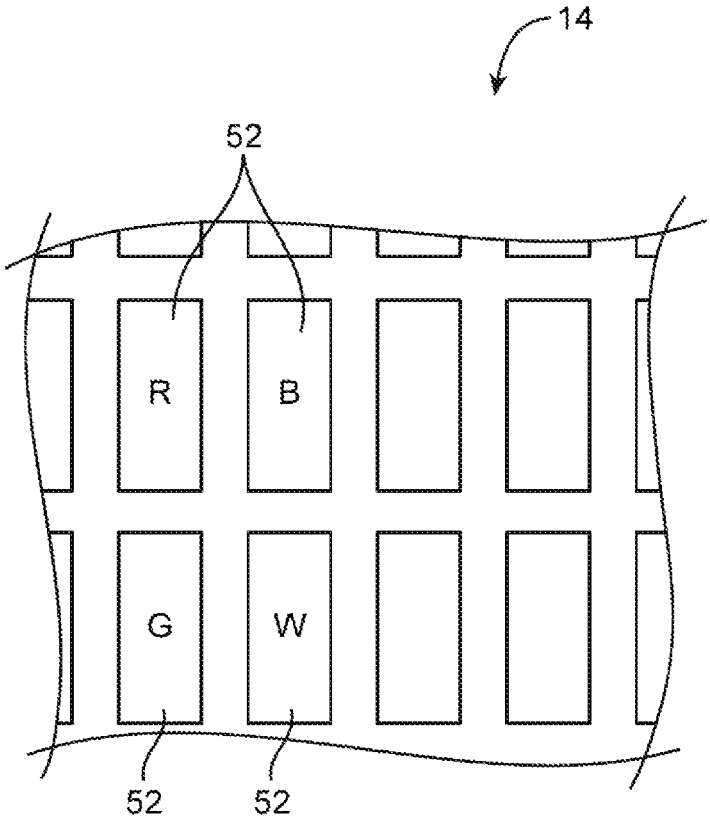
FIG. 6 is a diagram of a portion of an illustrative display showing how colored display pixels may be arranged in rows and columns in accordance with an embodiment of the present invention.

A portion of an illustrative array of display pixels that may be used in display 14 is shown in FIG. 6. As shown in FIG. 6, display 14 may have a pixel array with rows and columns of pixels such as display pixels 52. There may be tens, hundreds, or thousands of rows and columns of display pixels 52. Each pixel 52 may, if desired, be a color pixel such as a red (R) pixel, a green (G) pixel, a blue (B) pixel, a white (W) pixel, or a pixel of another color. Red pixels R, for example, may include a red color filter element formed over a white OLED pixel element (e.g., a white emitter). The red color filter element may be configured to pass red light while absorbing and/or reflecting non-red light. White pixels may be formed from a white OLED pixel element without a color filter.

This is, however, merely illustrative. If desired, red pixels, green pixels, and blue pixels may be formed respectively from red OLED pixel elements (e.g., red emitters), green OLED pixel elements, (e.g., green emitters), and blue OLED pixel elements (e.g., blue emitters). Arrangements in which pixel array 92 is formed from an RGB color filter array formed over an array of white OLED pixel elements is merely illustrative and is sometimes described herein as an example.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, blue, and white pixels are sometimes described herein as an example.

It should also be understood that the arrangement of colors shown in FIG. 6 is merely illustrative. Colored subpixels may be arranged in any suitable pattern (e.g., RGBW quad pattern, RGBW eight-subpixel repeat cell pattern, RGBW six-subpixel repeat cell pattern, other suitable patterns, etc.).

Display control circuitry 30 (FIG. 5) such as a display driver integrated circuit and, if desired, associated thin-film transistor circuitry formed on a display substrate layer may be used to produce signals such as data signals and gate line signals (e.g., on data lines and gate lines, respectively, in display 14) for operating pixels 52 (e.g., turning pixels 52 on and off, adjusting the intensity of pixels 52, etc.). During operation, display control circuitry 30 may control the values of the data signals and gate signals to control the light intensity associated with each of the display pixels and to thereby display images on display 14.

Display control circuitry 30 may obtain RGB values corresponding to the color to be displayed by a given pixel. Display control circuitry 30 may convert the RGB values into RGBW values by allocating a portion of the RGB luminance to the white subpixel. The RGBW values (sometimes referred to as digital display control values) may be converted into analog display signals for controlling the brightness of each pixel. The RGBW values (commonly integers with values ranging from 0 to 255) may correspond to the desired pixel intensity of each pixel. For example, a digital display control value of 0 may result in an "off" pixel, whereas a digital display control value of 255 may result in a pixel operating at a maximum available power.

It should be appreciated that these are examples in which each color channel has eight bits dedicated to it. Alternative embodiments may employ greater or fewer bits per color channel. For example, each color may, if desired, have six bits dedicated to it. With this type of configuration, RGBW values may be a set of integers ranging from 0 to 64. Arrangements in which each color channel has eight bits dedicated to it are sometimes described herein as an example.

The algorithm used to perform gamut mapping from RGB to RGBW may be updated on-the-fly. For example, a parameter P corresponding to the luminance contribution from the white subpixel may be updated on-the-fly based on the color content in a frame of display data (e.g., the amount of color saturation in a frame of display data), based on the power needed to display a frame of display data, based on information identifying what software is running on electronic device control circuitry, based on ambient conditions (e.g., ambient lighting conditions), and/or based on other factors. The greater the value of P, the larger the luminance contribution from the white subpixel. The parameter P is sometimes referred to as the white mixing ratio and may correspond to a value ranging from zero to one.

An illustrative algorithm for mapping RGB to RGBW may be based on the following equations:

$$R = (1 - P)R' + \frac{PW}{3}$$

$$G = (1 - P)G' + \frac{PW}{3}$$

$$B = (1 - P)B' + \frac{PW}{3}$$

where R', G', B' are RGB values in the RGB color space and where R, G, B, and W are RGBW values in the RGBW color space.

Figure 7:
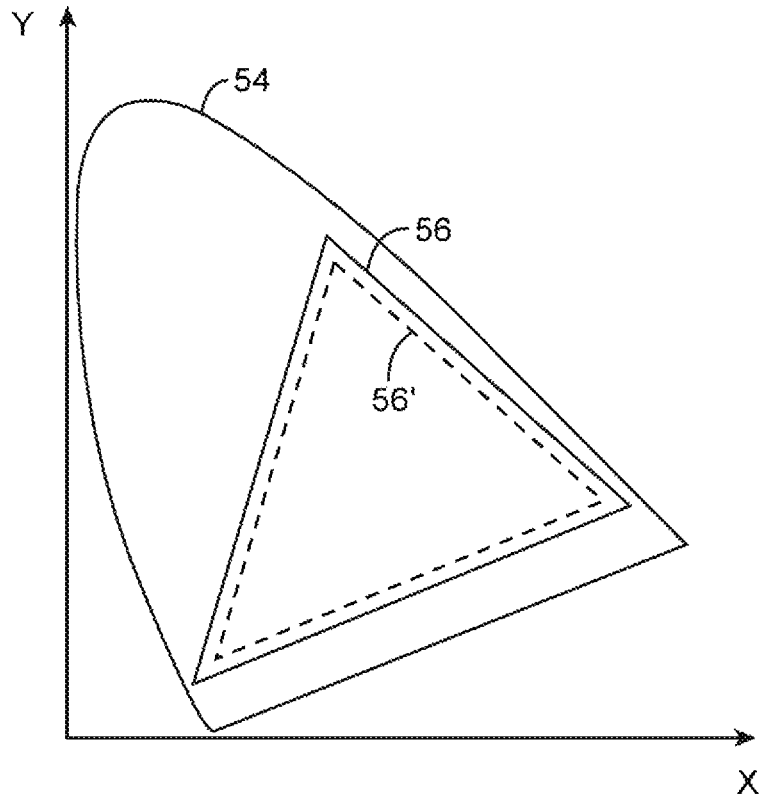
FIG. 7 is a chromaticity diagram showing how allocating a portion of RGB luminance to a white subpixel can affect the color gamut of a display.

Increasing the white mixing ratio will result in greater power efficiency but may affect the size of the color gamut of a display. A chromaticity diagram illustrating how adjusting the luminance contribution from the white subpixel can affect the size of a display's color gamut is shown in FIG. 7. The chromaticity diagram of FIG. 7 illustrates a two-dimensional projection of a three-dimensional color space. The color generated by a display such as display 14 may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing x=X/(X+Y+Z) and y=Y/(X+Y+Z) to obtain normalized x and y values). Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 7. Bounded region 54 of FIG. 7 represents the limits of visible light that may be perceived by humans (i.e., the total available color space). The colors that may be generated by a display are contained within a subregion of bounded region 54. For example, bounded region 56 may represent the color gamut of a display when all of the luminance associated with a given color is contributed by the red, green, and blue pixels (e.g., when the white mixing ratio is equal to zero). Bounded region 56' may represent the color gamut of a display when a relatively large portion of the RGB luminance is allocated to the white subpixel (e.g., when the white mixing ratio is equal to one). As shown in FIG. 7, bounded region 56' does not include some highly saturated colors (e.g., highly saturated colors with chromaticity coordinates that lie outside of region 56').

While it is possible to chose a fixed white mixing ratio that increases power efficiency without sacrificing the saturation of high luminance colors, the power savings allowed by this type of fixed white mixing ratio may not be sufficient in many scenarios. For example, images with a relatively large amount of gray colors and blue colors may still be power-limited even when some of the RGB luminance is contributed by the white subpixel. Images that are affected by a power-limited display can appear washed out and can exhibit undesirably low luminance.

To avoid using a gamut mapping algorithm that either sacrifices saturation of high luminance colors or provides insufficient power savings, the gamut mapping algorithm used in device 10 to map RGB to RGBW may be adaptive. For example, display control circuitry 30 may update the RGB to RGBW gamut mapping algorithm based on the color content in a frame of display data (e.g., the amount of color saturation in a frame of display data), based on the power needed to display a frame of display data, based on information identifying what software is running on electronic device control circuitry, based on ambient conditions (e.g., ambient lighting conditions), and/or based on other factors. Updating the gamut mapping algorithm used to map RGB to RGBW may include, for example, increasing or decreasing a portion of RGB luminance that is allocated to the white subpixel (i.e., the white mixing ratio).

Figure 8:
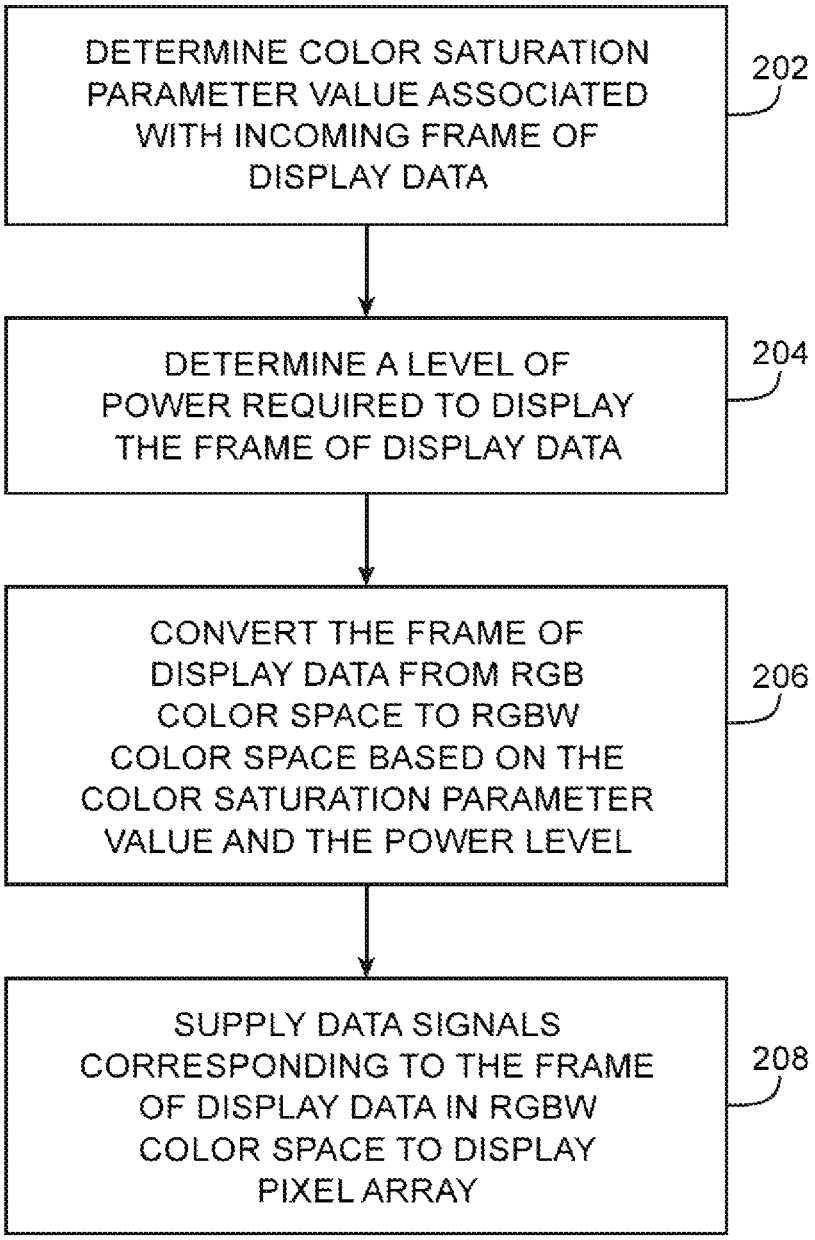
FIG. 8 is a flow chart of illustrative steps involved in adapting the color gamut of a display based on the color content in a frame of display data in accordance with an embodiment of the present invention.

A flowchart of illustrative steps involved in displaying images on display 14 using a gamut mapping algorithm that is updated based on the color content in a frame of display data and/or based on the power needed to display the frame of display data is shown in FIG. 8.

At step 202, display control circuitry 30 may obtain a frame of display data associated with an image to be displayed on display 14. For example, storage and processing circuitry 122 may produce data that is to be displayed on display 14. This display data may be provided to display control circuitry such as timing controller integrated circuit 126 using graphics processing unit 124. Timing controller 126 may analyze the color content associated with the incoming display data to determine a color saturation parameter value. For example, display control circuitry 30 (e.g., timing controller 126) may determine a percentage (i.e., a proportion or fraction) of highly saturated color content in a frame of display data. This may include determining what portion of the subpixel color values associated with the frame of display data have a value that is greater than a predetermined subpixel color value. Display control circuitry 30 may compare the proportion with a threshold proportion (e.g., a threshold proportion of 1%, 10%, 20%, 25%, 30%, etc.). Display control circuitry 30 may determine whether or not the proportion of highly saturated color content in the frame of display data falls above or below the threshold proportion.

Highly saturated color content may, for example, include colors having chromaticity coordinates that lie outside of bounded region 56' of FIG. 7. It should be understood, however, that what is defined as a "highly saturated color" is arbitrary and may, if desired, be determined on a per-device basis.

At step 204, display control circuitry 30 may determine the level of power needed to display the frame of display data on display 14. Because red, blue, green, and white subpixels may have different power efficiencies, the required power may, if desired, be determined independently for each color channel in order to estimate the level of power required to display the incoming frame of display data. Display control circuitry 30 may, for example, compare the estimated required power with a threshold power level and determine whether or not the required power is above or below the threshold power level.

At step 206, display control circuitry 30 may convert the incoming frame of display data from RGB color space to RGBW color space based on the color saturation parameter value and/or based on the required power level associated with the incoming display data. This may include, for example, updating the gamut mapping algorithm (e.g., updating the white mixing ratio used in the gamut mapping algorithm) based on the color saturation parameter value and required power level associated with the incoming display data. The updated gamut mapping algorithm may be used to convert RGB values associated with the frame of display data into corresponding RGBW values.

If desired, display control circuitry 30 may convert the incoming frame of display data from RGB color space to RGBW color space based on the color content parameter value alone. Converting the incoming frame of display data from RGB color space to RGBW color space based on the color saturation parameter value and required power level associated with the frame of display data is merely illustrative.

At step 208, display control circuitry 30 may provide data signals corresponding to the frame of display data in RGBW color space to pixel array 92. For example, timing controller 126 may provide the RGBW values associated with the frame of display data to column driver circuitry 120 using paths 128 of FIG. 5. Column driver circuitry 120 may receive the RGBW values and may use digital-to-analog converter circuitry to convert the RGBW values into corresponding analog output signals. Column driver circuitry 120 may provide the analog output signals to pixels 52 in pixel array 92.

Figure 9:
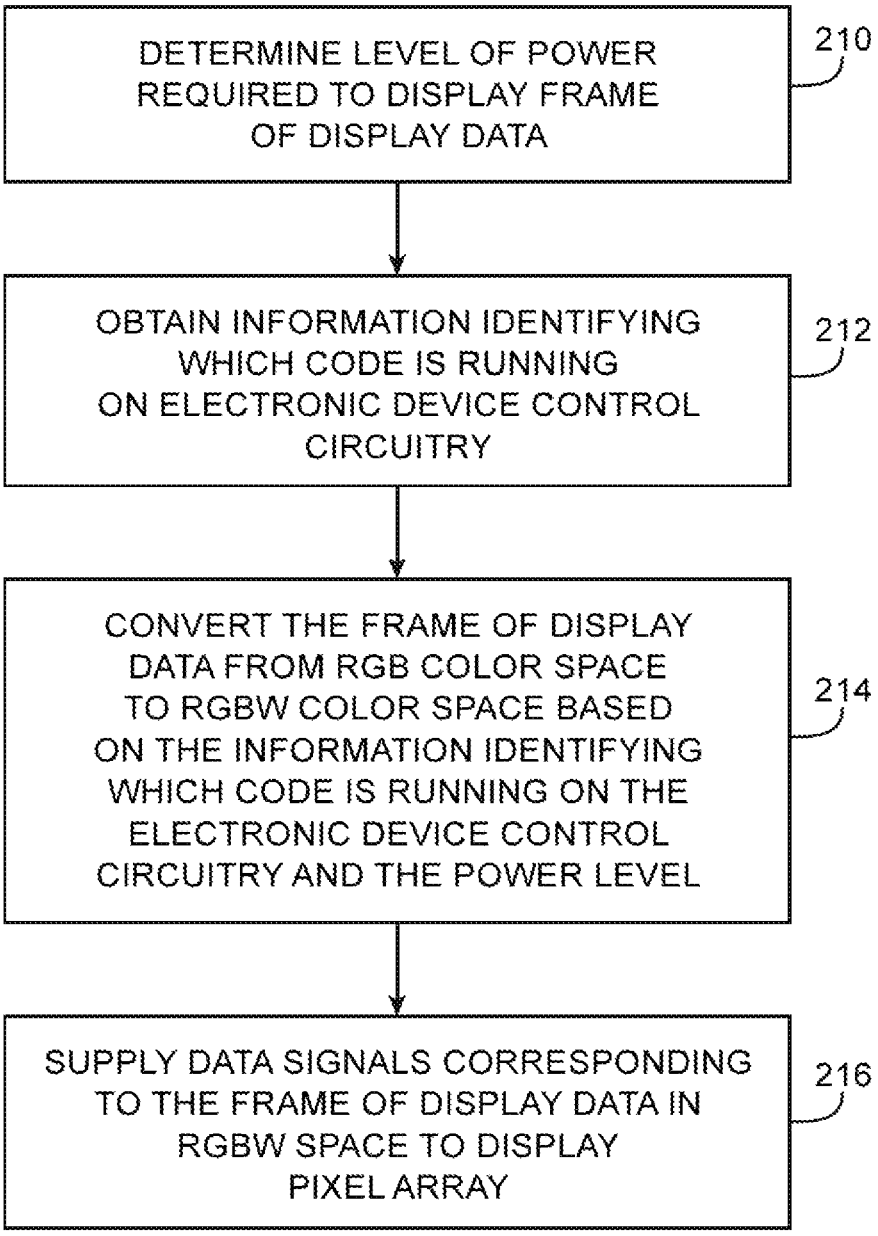
FIG. 9 is a flow chart of illustrative steps involved in adapting the color gamut of a display based information identifying what code is running on electronic device control circuitry in accordance with an embodiment of the present invention.

A flowchart of illustrative steps involved in displaying images on display 14 using a gamut mapping algorithm that is updated based on information indicating what code is running on electronic device control circuitry and based on the power needed to display a frame of display data is shown in FIG. 9.

At step 210, display control circuitry 30 may obtain a frame of display data associated with an image to be displayed on display 14 and may determine the level of power needed to display the frame of display data. Because red, blue, green, and white subpixels may have different power efficiencies, the required power may, if desired, be determined independently for each color channel in order to estimate the level of power required to display the incoming display content. Display control circuitry 30 may, for example, compare the estimated required power with a threshold power level and determine whether or not the required power is above or below the threshold power level.

At step 212, display control circuitry 30 may obtain information identifying which code is running on electronic device control circuitry (e.g., control circuitry 122 of FIG. 5) in electronic device 10. This may include, for example, obtaining information identifying which application code is being used to generate the frame of display data and/or determining which operating system code is being used to generate the frame of display data. Application code may include application software such as word processing software, graphics software, web browsing software, audio/video software, database software, spreadsheet software, presentation software, game software, other types of application software, combinations of these and other types of software, etc. If desired, display control circuitry 30 may also obtain information identifying which activities are being performed within a given software program. For example, display control circuitry 30 may determine whether graphics software is being used in a typography mode or in a photography mode.

If desired, information identifying which code is running on electronic device control circuitry may be pushed to the display control circuitry (e.g., may be pushed from storage and processing circuitry 122 to timing controller circuit 126) or the display control circuitry may pull the information identifying which code is running on electronic device control circuitry (e.g., timing controller circuit 126 may pull the information from storage and processing circuitry 122).

At step 214, display control circuitry 30 may convert the incoming frame of display data from RGB color space to RGBW color space based on the information identifying which code is running on the electronic device control circuitry and/or based on the required power level associated with the frame of display data. This may include, for example, updating the gamut mapping algorithm (e.g., updating the white mixing ratio used in the gamut mapping algorithm) based on the information identifying which code is being run on the electronic device control circuitry and based on the required power level associated with the incoming frame of display data. The updated gamut mapping algorithm may be used to convert RGB values associated with the frame of display data into corresponding RGBW values.

The code that is running on electronic device control circuitry may be indicative of the importance of preserving color saturation integrity and the importance of preserving luminance integrity when converting from RGB color space to RGBW color space. For example, presentation software may be used in generating display content such as presentation display content (e.g., dark text on a white background or other suitable presentation display content). In this type of scenario, it may be more important to a user to preserve luminance integrity than it would be to preserve saturation integrity of saturated colors (as an example). As another example, graphics software may be used in generating display content such as photographic display content (e.g., images of landscapes or other photographic content). In this type of scenario, it may be more important to the user to preserve saturation integrity of saturated colors than would be to preserve luminance integrity (as an example).

It should be understood, however, that a gamut mapping algorithm that preserves luminance integrity need not sacrifice color saturation integrity or perceived color saturation integrity. Likewise, a gamut mapping algorithm that preserves color saturation integrity need not sacrifice luminance integrity or perceived luminance integrity.

If desired, display control circuitry 30 may convert the incoming frame of display data from RGB color space to RGBW color space based on the information identifying which code is running on electronic device control circuitry alone. Converting the incoming frame of display data from RGB color space to RGBW color space based on this information and the required power level associated with the incoming display data is merely illustrative.

At step 216, display control circuitry 30 may provide data signals corresponding to the frame of display data in RGBW color space to pixel array 92. For example, timing controller 126 may provide the RGBW values associated with the frame of display data to column driver circuitry 120 using paths 128 of FIG. 5. Column driver circuitry 120 may receive the RGBW values and may use digital-to-analog converter circuitry to convert the RGBW values into corresponding analog output signals. Column driver circuitry 120 may provide the analog output signals to pixels 52 in pixel array 92.

Figure 10:
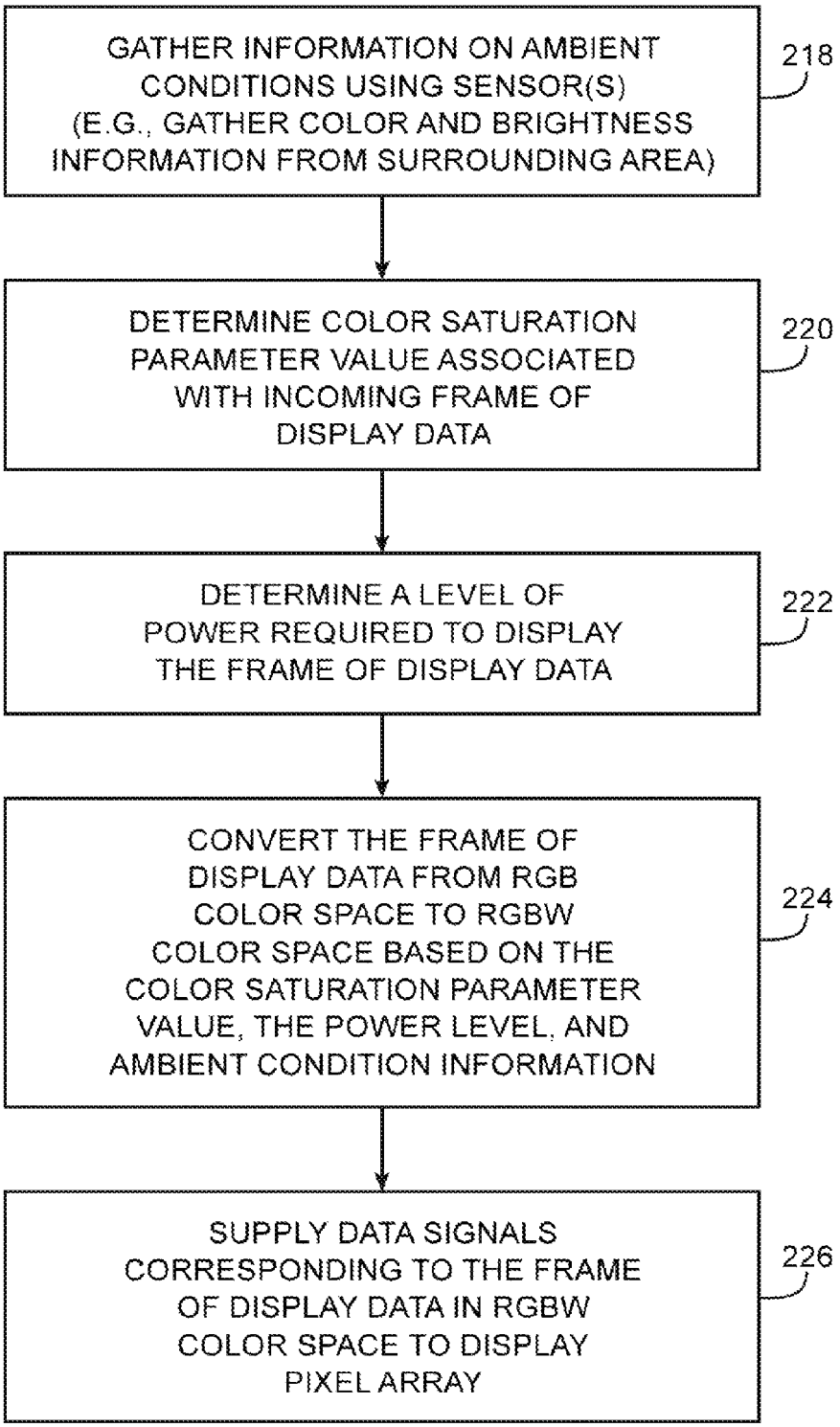
FIG. 10 is a flow chart of illustrative steps involved in adapting the color gamut of a display based on the color content in a frame of display data and based on ambient lighting conditions in accordance with an embodiment of the present invention.

A flowchart of illustrative steps involved in displaying images on display 14 using a gamut mapping algorithm that is updated based on the color content in a frame of display data, the power needed to display the frame of display data, and the ambient conditions around the display is shown in FIG. 10.

At step 218, one or more sensors in device 10 such as sensor 36 of FIG. 5 may be used to gather information on ambient conditions (e.g., ambient lighting conditions). This may include, for example, gathering color information, brightness information, color temperature information, and/or other information on the surrounding area around device 10.

At step 220, display control circuitry 30 may obtain a frame of display data associated with an image to be displayed on display 14. For example, storage and processing circuitry 122 may produce data that is to be displayed on display 14. This display data may be provided to display control circuitry such as timing controller integrated circuit 126 using graphics processing unit 124. Timing controller 126 may analyze the color content associated with the incoming display data to determine a color saturation parameter value. For example, display control circuitry 30 (e.g., timing controller 126) may determine a percentage (i.e., a proportion or fraction) of highly saturated color content in a frame of display data. This may include determining what portion of the subpixel color values associated with the frame of display data have a value that is greater than a predetermined subpixel color value. Display control circuitry 30 may compare the proportion with a threshold proportion (e.g., a threshold proportion of 1%, 10%, 20%, 25%, 30%, etc.). Display control circuitry 30 may determine whether or not the proportion of highly saturated color content in the frame of display data falls above or below the threshold proportion.

Highly saturated color content may, for example, include colors having chromaticity coordinates that lie outside of bounded region 56' of FIG. 7. It should be understood, however, that what is defined as a "highly saturated color" is arbitrary and may, if desired, be determined on a per-device basis.

At step 222, display control circuitry 30 may determine the level of power needed to display the frame of display data on display 14. Because red, blue, green, and white subpixels may have different power efficiencies, the required power may, if desired, be determined independently for each color channel in order to estimate the level of power required to display the incoming frame of display data. Display control circuitry 30 may, for example, compare the estimated required power with a threshold power level and determine whether or not the required power is above or below the threshold power level.

At step 224, display control circuitry 30 may convert the incoming frame of display data from RGB color space to RGBW color space based on the color saturation parameter value, the required power level associated with the frame of display data, and/or the ambient lighting condition information. This may include, for example, updating the gamut mapping algorithm (e.g., updating the white mixing ratio used in the gamut mapping algorithm) based on the color saturation parameter value, the required power level associated with the frame of display data, and the ambient lighting condition information. The updated gamut mapping algorithm may be used to convert RGB values associated with the frame of display data into corresponding RGBW values.

Updating the gamut mapping algorithm may, for example, include increasing the luminance contribution from the white subpixel (e.g., by increasing the white mixing ratio) in bright ambient lighting conditions (as an example). Increasing the luminance contribution from the white subpixel in bright ambient lighting conditions may increase the clarity and quality of images on display 14 and may help prevent display 14 from appearing washed out in the bright ambient lighting conditions. This is, however, merely an illustrative example.

If desired, display control circuitry 30 may convert the incoming frame of display data from RGB color space to RGBW color space based on the color content parameter value alone, based on the ambient lighting condition information alone, or based on the required power level alone. Converting the incoming frame of display data from RGB color space to RGBW color space based on the color saturation parameter value, the ambient lighting conditions, and the required power level associated with frame of display data is merely illustrative.

At step 226, display control circuitry 30 may provide data signals corresponding to the frame of display data in RGBW color space to pixel array 92. For example, timing controller 126 may provide the RGBW values associated with the frame of display data to column driver circuitry 120 using paths 128 of FIG. 5. Column driver circuitry 120 may receive the RGBW values and may use digital-to-analog converter circuitry to convert the RGBW values into corresponding analog output signals. Column driver circuitry 120 may provide the analog output signals to pixels 52 in pixel array 92.

Figure 11:
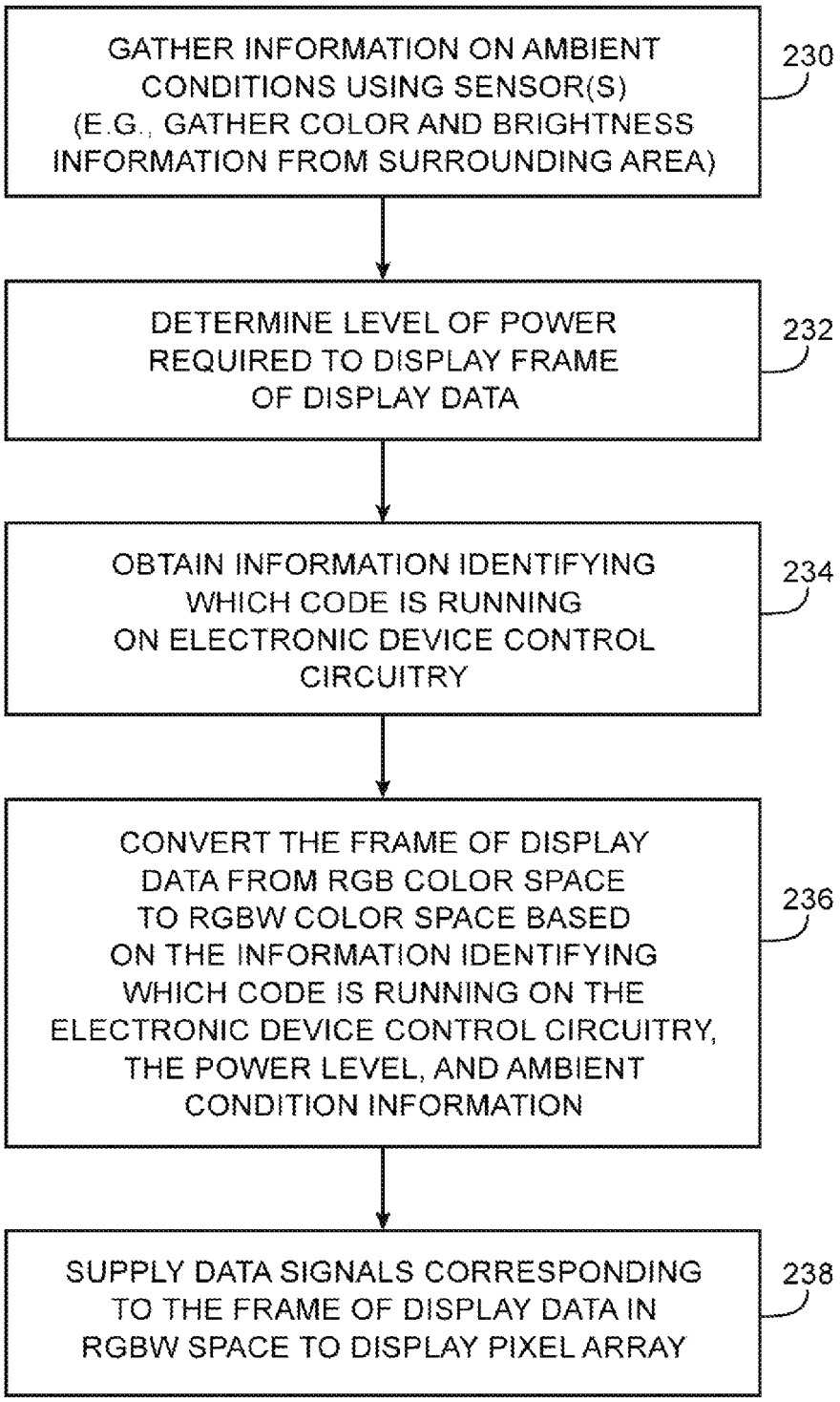
FIG. 11 is a flow chart of illustrative steps involved in adapting the color gamut of a display based on the application being used to display an image and based on ambient lighting conditions in accordance with an embodiment of the present invention.

A flowchart of illustrative steps involved in displaying images on display 14 using a gamut mapping algorithm that is updated based on information indicating what code is running on electronic device control circuitry, the power needed to display a frame of display data, and the ambient conditions around the display is shown in FIG. 11.

At step 230, one or more sensors in device 10 such as sensor 36 of FIG. 5 may be used to gather information on ambient conditions. This may include, for example, gathering color information, brightness information, color temperature information, and/or other information on the surrounding area around device 10.

At step 232, display control circuitry 30 may determine the level of power needed to display the frame of display data on display 14. Because red, blue, green, and white subpixels may have different power efficiencies, the required power may, if desired, be determined independently for each color channel in order to estimate the level of power required to display the incoming frame of display data. Display control circuitry 30 may, for example, compare the estimated required power with a threshold power level and determine whether or not the required power is above or below the threshold power level.

At step 234, display control circuitry 30 may obtain information identifying which code is running on electronic device control circuitry (e.g., control circuitry 122 of FIG. 5) in electronic device 10. This may include, for example, obtaining information identifying which application code is being used to generate the frame of display data and/or determining which operating system code is being used to generate the frame of display data. Application code may include application software such as word processing software, graphics software, web browsing software, audio/video software, database software, spreadsheet software, presentation software, game software, other types of application software, combinations of these and other types of software, etc. If desired, display control circuitry 30 may also obtain information identifying which activities are being performed within a given software program. For example, display control circuitry 30 may determine whether graphics software is being used in a typography mode or in a photography mode.

If desired, information identifying which code is running on electronic device control circuitry may be pushed to the display control circuitry (e.g., may be pushed from storage and processing circuitry 122 to timing controller circuit 126) or the display control circuitry may pull the information identifying which code is running on electronic device control circuitry (e.g., timing controller circuit 126 may pull the information from storage and processing circuitry 122).

At step 236, display control circuitry 30 may convert the incoming frame of display data from RGB color space to RGBW color space based on the information identifying which code is running on the electronic device control circuitry, based on the ambient lighting condition information, and/or based on the required power level associated with the frame of display data. This may include, for example, updating the gamut mapping algorithm (e.g., updating the white mixing ratio used in the gamut mapping algorithm) based on the information identifying which code is being run on the electronic device control circuitry, based on the ambient lighting condition information, and based on the required power level associated with the frame of display data. The updated gamut mapping algorithm may be used to convert RGB values associated with the frame of display data into corresponding RGBW values.

The code that is running on electronic device control circuitry may be indicative of the importance of preserving color saturation integrity and the importance of preserving luminance integrity when converting from RGB color space to RGBW color space. For example, presentation software may be used in generating display content such as presentation display content (e.g., dark text on a white background or other suitable presentation display content). In this type of scenario, it may be more important to a user to preserve luminance integrity than it would be to preserve saturation integrity of saturated colors (as an example). As another example, graphics software may be used in generating display content such as photographic display content (e.g., images of landscapes or other photographic content). In this type of scenario, it may be more important to the user to preserve saturation integrity of saturated colors than would be to preserve luminance integrity (as an example).

It should be understood, however, that a gamut mapping algorithm that preserves luminance integrity need not sacrifice color saturation integrity or perceived color saturation integrity. Likewise, a gamut mapping algorithm that preserves color saturation integrity need not sacrifice luminance integrity.

If desired, display control circuitry 30 may convert the incoming frame of display data from RGB color space to RGBW color space based on the information identifying which code is running on electronic device control circuitry alone, based on the ambient lighting condition information alone, or based on the required power level alone. Converting the incoming frame of display data from RGB color space to RGBW color space based on the information identifying which code is running on electronic device control circuitry, the ambient lighting conditions, and the required power level associated with frame of display data is merely illustrative.

At step 238, display control circuitry 30 may provide data signals corresponding to the frame of display data in RGBW color space to pixel array 92. For example, timing controller 126 may provide the RGBW values associated with the frame of display data to column driver circuitry 120 using paths 128 of FIG. 5. Column driver circuitry 120 may receive the RGBW values and may use digital-to-analog converter circuitry to convert the RGBW values into corresponding analog output signals. Column driver circuitry 120 may provide the analog output signals to pixels 52 in pixel array 92.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying a frame of display data comprising red, green, and blue subpixel values on an array of display pixels in a display, comprising:

with display control circuitry in the display, determining a color saturation parameter value representative of an amount of color saturation of the frame of the display data that includes the red, green, and blue subpixel values, wherein determining the color saturation parameter value of the frame of the display data comprises determining what portion of the red subpixel values have a value greater than a predetermined red subpixel value, determining what portion of the green subpixel values have a value greater than a predetermined green subpixel value, and determining what portion of the blue subpixel values have a value greater than a predetermined blue subpixel value;

with the display control circuitry in the display, obtaining ambient lighting condition information from a light sensor; and with the display control circuitry in the display, converting the frame of display data from a red-green-blue color space to a red-green-blue-white color space based at least partly on the color saturation parameter value, wherein converting the frame of display data comprises applying a white mixing ratio to the red, green, and blue values to generate a white value based at least partly on the ambient lighting condition information, wherein the white mixing ratio that is applied to the red, green, and blue values has a first value when the obtained ambient lighting information indicates a first ambient light level such that the generated white value provides a first portion of a luminance of the frame of display data when the obtained ambient lighting information indicates the first ambient light level, and wherein the white mixing ratio that is applied to the red, green, and blue values is increased to a second value that is greater than the first value when the obtained ambient lighting information indicates a second ambient light level that is greater than the first ambient light level such that the white value provides a second portion of the luminance of the frame of display data that is greater than the first portion when the obtained ambient lighting information indicates the second ambient light level.

2. The method defined in claim 1 further comprising:

with the display control circuitry, supplying data signals corresponding to the frame of display data in the red-green-blue-white color space to the array of display pixels.

3. The method defined in claim 2 wherein the display pixels each include a red subpixel, a green subpixel, a blue subpixel, and a white subpixel and wherein supplying the data signals comprises supplying the data signals to the red subpixels, green subpixels, blue subpixels, and white subpixels in the display.

4. The method defined in claim 1 further comprising:

with the display control circuitry, estimating an amount of power required to display the frame of display data.

5. The method defined in claim 4 wherein converting the frame of display data from the red-green-blue color space to the red-green-blue-white color space comprises converting the frame of display data from the red-green-blue color space to the red-green-blue-white color space based at least partly on the amount of power.

6. The method defined in claim 1 wherein the display control circuitry comprises a timing controller integrated circuit and wherein converting the frame of display data from the red-green-blue color space to the red-green-blue-white color space based at least partly on the color saturation parameter value comprises:

with the timing controller integrated circuit, converting the frame of display data from the red-green-blue color space to the red-green-blue-white color space based at least partly on the color saturation parameter value.

7. A method for displaying display data on an array of display pixels in a display in an electronic device having control circuitry that runs code, comprising:

with display control circuitry in the display, obtaining information identifying which code is running on the control circuitry and determining an amount of power required to display a frame of display data; and with the display control circuitry in the display, converting the frame of display data from a red-green-blue color space to a red-green-blue-white color space based at least partly on the information identifying which code is running on the control circuitry and at least partly based on the amount of power required to display the frame of display data, wherein the amount of power required to display the frame of display data is determined independently for red, green, and blue color channels in the frame of display data.

8. The method defined in claim 7 further comprising:

with the display control circuitry, supplying data signals corresponding to the frame of display data in the red-green-blue-white color space to the array of display pixels.

9. The method defined in claim 8 wherein the display pixels comprise organic light-emitting diode display pixels, wherein each organic light-emitting diode display pixel includes a red subpixel, a green subpixel, a blue subpixel, and a white subpixel, and wherein supplying the data signals comprises supplying the data signals to the red subpixels, green subpixels, blue subpixels, and white subpixels in the display.

10. The method defined in claim 7 wherein the control circuitry in the electronic device runs code associated with application software and wherein obtaining information identifying which code is running on the control circuitry comprises obtaining information identifying which application software is running on the control circuitry.

11. The method defined in claim 7 further comprising:

with the display control circuitry in the display, determining a color saturation parameter value representative of an amount of color saturation associated with the frame of the display data, wherein converting the frame of display data from the red-green-blue color space to the red-green-blue-white color space comprises converting the frame of display data from the red-green-blue color space to the red-green-blue-white color space based at least partly on the color saturation parameter value.

12. A method for displaying display data comprising red, green, and blue values on an array of display pixels in a display, comprising:

with display control circuitry in the display, obtaining ambient lighting condition information from a light sensor; and with the display control circuitry in the display, converting a frame of display data from a red-green-blue color space to a red-green-blue-white color space based at least partly on the ambient lighting condition information, wherein converting the frame of display data comprises applying a white mixing ratio to the red, green, and blue values to generate a white value based at least partly on the ambient lighting condition information, wherein the white mixing ratio that is applied to the red, green, and blue values has a first value when the obtained ambient lighting information indicates a first ambient light level such that the generated white value provides a first portion of a luminance of the frame of display data when the obtained ambient lighting information indicates the first ambient light level, and wherein the white mixing ratio that is applied to the red, green, and blue values is increased to a second value that is greater than the first value when the obtained ambient lighting information indicates a second ambient light level that is greater than the first ambient light level such that the white value provides a second portion of the luminance of the frame of display data that is greater than the first portion when the obtained ambient lighting information indicates the second ambient light level.

13. The method defined in claim 12 further comprising:

with the display control circuitry, supplying data signals corresponding to the frame of display data in the red-green-blue-white color space to the array of display pixels.

14. The method defined in claim 13 wherein the display pixels each include a red subpixel, a green subpixel, a blue subpixel, and a white subpixel and wherein supplying the data signals comprises supplying the data signals to the red subpixels, green subpixels, blue subpixels, and white subpixels in the display.

15. The method defined in claim 13 wherein the display control circuitry comprises a timing controller integrated circuit, wherein the display pixels comprise organic light-emitting diode display pixels, and wherein supplying the data signals to the array of display pixels comprises:

with the timing controller integrated circuit, supplying the data signals to the array of organic light-emitting diode pixels.

16. The method defined in claim 12 wherein the display is mounted in an electronic device having electronic device control circuitry that runs code, the method further comprising:

with the display control circuitry in the display, obtaining information identifying which code is running on the electronic device control circuitry, wherein converting the frame of display data from the red-green-blue color space to the red-green-blue-white color space comprises converting the frame of display data from the red-green-blue color space to the red-green-blue-white color space based at least partly on the information identifying which code is running on the electronic device control circuitry.

17. The method defined in claim 16 wherein the electronic device control circuitry runs code associated with application software and wherein obtaining information identifying which code is running on the control circuitry comprises obtaining information identifying which application software is running on the electronic device control circuitry.

* * * * *